US009011115B2

(12) United States Patent
Schlenhoff et al.

(10) Patent No.: US 9,011,115 B2
(45) Date of Patent: Apr. 21, 2015

(54) RADIAL BEARINGS FOR DEEP WELL SUBMERSIBLE PUMPS

(71) Applicant: Flowserve Management Company, Irving, TX (US)

(72) Inventors: Behrend Goswin Schlenhoff, Hamburg (DE); Axel Helmut Tank-Langenau, Remmels (DE); Thomas Albers, Ahrensburg (DE)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 14/066,840

(22) Filed: Oct. 30, 2013

(65) Prior Publication Data

US 2014/0050594 A1 Feb. 20, 2014

Related U.S. Application Data

(62) Division of application No. 12/563,490, filed on Sep. 21, 2009, now Pat. No. 8,602,753.

(51) Int. Cl.

| | |
|---|---|
| ***F04B 35/04*** | (2006.01) |
| ***F04D 13/08*** | (2006.01) |
| ***F04D 29/047*** | (2006.01) |
| ***F04D 29/06*** | (2006.01) |

(52) U.S. Cl.

CPC ..... *F04D 13/08* (2013.01); *F04D 29/047* (2013.01); *F04D 29/061* (2013.01)

(58) Field of Classification Search

CPC ..... F04B 47/00; F04B 47/06

USPC ..... 384/97, 322, 378, 397, 414, 415, 471, 384/472, 473; 166/68, 68.5, 105; 417/366, 417/367, 368, 423.13, 423.3, 53, 423.7; 60/641.2, 641.4; 310/52–65

See application file for complete search history.

(56) References Cited

U.S. PATENT DOCUMENTS

| | | | | |
|---|---|---|---|---|
| 2,064,086 | A | | 12/1936 | Short et al. |
| 2,592,612 | A | * | 4/1952 | Smith, Jr. ..... 417/316 |
| 3,786,901 | A | | 1/1974 | Randell |
| 4,507,925 | A | | 4/1985 | Schaetzle et al. |
| 4,620,804 | A | | 11/1986 | Goyne |
| 4,913,239 | A | | 4/1990 | Bayh, III |
| 5,713,670 | A | | 2/1998 | Goldowsky |
| 6,176,619 | B1 | | 1/2001 | Nagasaka et al. |
| 7,517,721 | B2 | | 4/2009 | Ito et al. |

(Continued)

FOREIGN PATENT DOCUMENTS

| | | |
|---|---|---|
| DE | 12 69 843 | 2/1965 |
| DE | 199 16 067.8 A1 | 4/1999 |

(Continued)

*Primary Examiner* — Peter J Bertheaud
*Assistant Examiner* — Dnyanesh Kasture
(74) *Attorney, Agent, or Firm* — Dinsmore & Shohl LLP

(57) ABSTRACT

A bearing assembly for use in a deepwell submersible pump, the pump and a method of pumping a geothermal fluid. The bearing assembly is constructed to include a lubricant conveying mechanism, a bearing sleeve and a multilayer bushing. The lubricant is forced between the bushing and a bearing sleeve by the lubricant conveying mechanism that cooperates with the rotation of a shaft used to connect a power-providing motor with one or more pump impellers. In this way, there exists a substantially continuous lubricant environment between the sleeve and bushing to act in a hydrodynamic fashion.

19 Claims, 5 Drawing Sheets

(56) References Cited

U.S. PATENT DOCUMENTS

| | | | | |
|---|---|---|---|---|
| 2004/0013332 | A1 | 1/2004 | Sturm et al. | |
| 2009/0169358 | A1 | 7/2009 | Sullivan | |
| 2009/0269224 | A1 | 10/2009 | Hunt et al. | |
| 2009/0272129 | A1 | 11/2009 | Petty | |
| 2010/0244595 | A1* | 9/2010 | Sheth | 310/54 |
| 2010/0329908 | A1 | 12/2010 | Martinez et al. | |
| 2012/0089103 | A1 | 4/2012 | Tel-Ari | |

FOREIGN PATENT DOCUMENTS

| | | |
|---|---|---|
| GB | 546223 | 7/1942 |
| GB | 580128 | 8/1946 |

* cited by examiner

RADIAL BEARINGS FOR DEEP WELL SUBMERSIBLE PUMPS

CROSS-REFERENCE TO RELATED APPLICATIONS

This application is a divisional of (and now allowed) U.S. patent application Ser. No. 12/563,490, filed Sep. 21, 2009 and entitled "RADIAL BEARINGS FOR DEEP WELL SUBMERSIBLE PUMPS".

BACKGROUND OF THE INVENTION

The present invention relates generally to bearings for use in deep well submersible pump systems, and more particularly to such bearings used to transmit radial loads and that are exposed to high temperature fluids being pumped by submersible pump systems.

Deep-well submersible (DWS) pumping systems (also referred to as electric submersible pumps (ESP)) are especially useful in extracting valuable resources such as oil, gas and water from deep well geological formations. In one particular operation, a DWS pump unit can be used to retrieve geothermal resources, such as hot water, from significant subterranean depths. In a conventional configuration, a generally centrifugal pump section and a motor section that powers the pump section are axially aligned with one another and oriented vertically in the well. More particularly, the motor section is situated at the lower end of the unit, and drives one or more pump section stages mounted above.

Because DWS pumping systems are relatively inaccessible (often completely submerged at distances between about 400 and 700 meters beneath the earth's surface), they must be able to run for extended periods without requiring maintenance. Such extended operating times are especially hard on the bearings that must absorb radial and axial forces of the rotor that is used to transmit power from the motor section to the impellers of the pump section. Radial bearings are one form of bearings employed in DWS systems, and are often spaced along the length of the rotor, particularly in a region where two axially adjacent rotor sections (such as between adjacent pump bowls in a serial multi-bowl assembly) are joined. These bearings are generally configured as sleeve-like sliding surfaces that are hydro dynamically lubricated between the surfaces by a contacting liquid. In one form, radial bearings in the pump section are situated in bowls that are lubricated by the fluid being pumped, while radial bearings in the motor section are lubricated by a coolant used to fill portions of the motor housing. For motors used in geothermal applications, the motor section lubricant is typically oil.

Conventional radial bearings for submersible DWS systems are not configured to withstand the high operating temperatures and pressures associated with the DWS environment, and as such have been prone to early failure. For example, in situations involving geothermal wells, the water being extracted from the earth may be 120 to 160 degrees Celsius or more, making the job of an on-board coolant (whether it be oil-based or water-based) all the more difficult. In addition, any impurities in the water that come in contact with the bearing surfaces of the pump section could leave deposits that may contribute to premature bearing wear or other operability problems. The problem is also particularly acute in the motor section, where radial bearing are generally not configured to guide or otherwise introduce sufficient motor cooling fluid into the bearing contact surface to promote adequate lubrication, especially at the elevated temperatures experienced inside the DWS motor section. That the hydrodynamic properties of the bearing need to be maintained not only in high temperature environments where the lubricating liquid has low viscosity, but also during start-up and shut-down phases of motor operation when the lubricating liquid generally is highly viscous (or not even present) exacerbates the design challenges. As such, there exists a desire for a bearing suitable for operation in deep well environments.

BRIEF SUMMARY OF THE INVENTION

These desires are met by the present invention, where bearings for use in geothermal and related deep well environments are disclosed. In accordance with a first aspect of the invention, a bearing assembly for use in a DWS pump is disclosed. The assembly includes a bearing housing that can be attached to or formed as part of the pump, a sliding bearing positioned within the housing and a fluid conveying mechanism, where at least the bearing is rotatably positioned within the housing. The fluid conveying mechanism is configured to deliver a lubricant between a multilayer bushing and a bearing sleeve that make up the sliding bearing. In this way, a chamber that encompasses at least the sliding bearing defines a substantially continuous lubricating environment between the sleeve and bushing, capable of providing lubrication in both hot and cold environments, as well as during pump startup, in addition to other operating conditions. The bushing is of a multilayer construction, and is disposed against an inner surface of the housing. The bearing sleeve is concentrically disposed within the multilayer bushing and cooperative with it such that the sleeve rotates relative to the bushing.

Optionally, the multilayer bushing is made up of one or more metal layers and a layer of a non-metal that can be used to coat or otherwise cover the one or more metal layers. In a more particular form, the non-metal layer is made up of an electrically nonconductive material that forms an outermost layer of the multilayer bushing. In an even more particular form, the electrically nonconductive material is polyaryletheretherketone (PEEK) or a related engineered material. In another form, a plurality of metal layers can be used, where such layers may include a galvanized tin layer, a bronze layer and a steel layer. One particular form of the fluid conveying mechanism is a shaft-mounted conveying screw and a housing-mounted conveying screw cooperative with one another to define a lubricant pumping passage between them. In this way, the shaft-mounted conveying screw rotates in response to the turning of the shaft to act as a lubricant-pumping device that can produce an increase in pressure in the lubricant such that the lubricant squeezes between the adjacent bushing and bearing sleeve surfaces. In an even more particular embodiment, the multilayer bushing is made up of numerous metal layers surrounded with an outermost layer of an electrically nonconductive material (such as the aforementioned PEEK). In another option, the bearing is constructed so that it can operate in high temperature operating environments, where the temperature of a fluid being pumped by the DWS is at least between 120° and 160° Celsius, for example, such as those commonly found in deep well geothermal applications.

According to another aspect of the invention, a DWS pump is disclosed. The pump includes a motor section, a pump section and a bearing assembly coupled to at least one of the motor and pump sections. The bearing assembly includes a bearing sleeve, a bushing and a fluid conveying mechanism. The bearing sleeve is cooperative with a shaft to transfer radial loads from the shaft to a pump housing, while the bushing cooperates with the bearing sleeve to define a lubricant flow path between them. The bushing includes a multilayer construction with at least one of the layers comprising metal. The material use and construction of the bearing and the bushing is such that they can operate in a substantially continuous high temperature environment, where for example, the fluid being pumped is at least between 120° and 160° Celsius. The fluid conveying mechanism is designed to be in fluid communication with the bearing sleeve and the bushing during pump operation. In this way, the fluid conveying mechanism receives a lubricant from a lubricant source. The fluid conveying mechanism operates to pressurize the lubricant such that it flows between the multilayer bushing and the bearing sleeve to achieve the substantially continuous lubrication of the bearing sleeve and bushing during startup and subsequent operation of the pump. In one form, the source of lubricant is self-contained so that once the lubricating fluid has been passed through the interstitial-like region defined between the sleeve and bushing, it can be recirculated for reuse. In addition to the shaft mentioned above, the motor section is made up of a stator configured to receive electric current from a source of electric power and a rotor inductively responsive to an electromagnetic field established in the stator. Likewise, the pump section, in addition to the inlet and outlet, is made up of at least one impeller rotatably coupled to the shaft such that pressurization of the fluid being pumped from the deep well moves the fluid from the fluid inlet to the fluid outlet.

Optionally, the one or more metal layers of the multilayer bushing are made up of numerous metal layers at least one of which is steel. In a more particular form the layers may include a galvanized tin layer disposed on the inner surface of the radial bearing, a bronze layer disposed around the galvanized tin layer and the steel layer disposed around the bronze layer. Even more particularly, the bushing includes an outermost (i.e., top) layer of electrically non-conductive material disposed on the outer surface of the radial bearing. Such electrically non-conductive material may be PEEK or some related structurally-compatible material. In a particular form, the fluid conveying mechanism may include a shaft-mounted conveying screw and a housing-mounted conveying screw cooperative with one another to define a rotating lubricant pumping passage between them. In situations where the motor section employs one or more of the radial bearing assemblies, the bearings making up the assembly can be lubricated by an oil that can also serve as a coolant for the motor. Likewise, in situations where the pump section employs one or more radial bearing assemblies, such assemblies can be configured to be lubricated by the geothermal fluid being pumped.

According to yet another aspect of the invention, a method of pumping a geothermal fluid is disclosed. The method includes placing a DWS pump in fluid communication with a source of geothermal fluid and operating the pump such that geothermal fluid that is introduced into the pump through the inlet is discharged through the outlet. The pump includes a motor, fluid inlet and outlet and one or more impellers. In addition, the pump includes one or more bearing assemblies that have a bearing sleeve and a bushing cooperative with one another to define a lubricant pumping flow path between them.

The bushing is further made of a multilayer construction with at least one of the layers made from a metal. The bearing assembly further includes a pressurizing device (such as a conveying screw, as discussed below) that receives and pressurizes a fluid that can be used as a lubricant, forcing it to flow between the multilayer bushing and the bearing sleeve. In this way, a substantially continuous liquid environment is formed between the components of a bearing assembly by the pressurizing device during operation of the pump. Such liquid being pressurized for use in the motor is preferably an oil (which, in addition to performing lubricating functions, also works as a coolant and electrical insulation), while such liquid being operated upon by the pump impellers is preferably water from the geothermal source.

Optionally, the bushing and the bearing sleeve are configured to operate in a high temperature environment, such as a substantially continuous aqueous environment of at least 120° and 160° Celsius. The multilayer construction of the bushing may be made up of numerous metal layers, including dissimilar metal layers. Furthermore, the multilayer construction may include a non-metallic layer. In a preferred form, the non-metallic layer is made from PEEK, which helps perform an insulation function. In a more particular form, the PEEK layer forms the outermost layer of the bushing such that upon cooperation with a complementary inner surface of a bearing housing or related structure, a flow path for pressurized liquid that is pumped from between the bushing and the bearing is created with at least one of the surfaces being made from PEEK. The other layers may be made from steel (which can act as a carrier or housing), bronze (which may function as the main sliding partner cooperative with the rotor), tin (which may serve as a sliding partner to the rotor as a run-in layer during startup. The non-metallic layer may be made from a material that has been engineered to achieve a very low coefficient of static friction.

Moreover, the method may include mounting (or otherwise securing) a first cooperative pumping mechanism to a static (i.e., non-rotational) portion of the bearing assembly, and mounting or securing a second cooperative pumping mechanism to the shaft. In this way, upon rotation of the shaft, the first and second pumping mechanisms cooperate to achieve the necessary lubricant pressurization. The first and second pumping mechanisms may include threaded surfaces that cooperate to achieve such pressurization. Such threads may, for example, define a generally continuous screw-like spiral shape.

BRIEF DESCRIPTION OF SEVERAL VIEWS OF THE DRAWINGS

The following detailed description of specific embodiments can be best understood when read in conjunction with the following drawings, where like structure is indicated with like reference numerals and in which.

Figure 1:
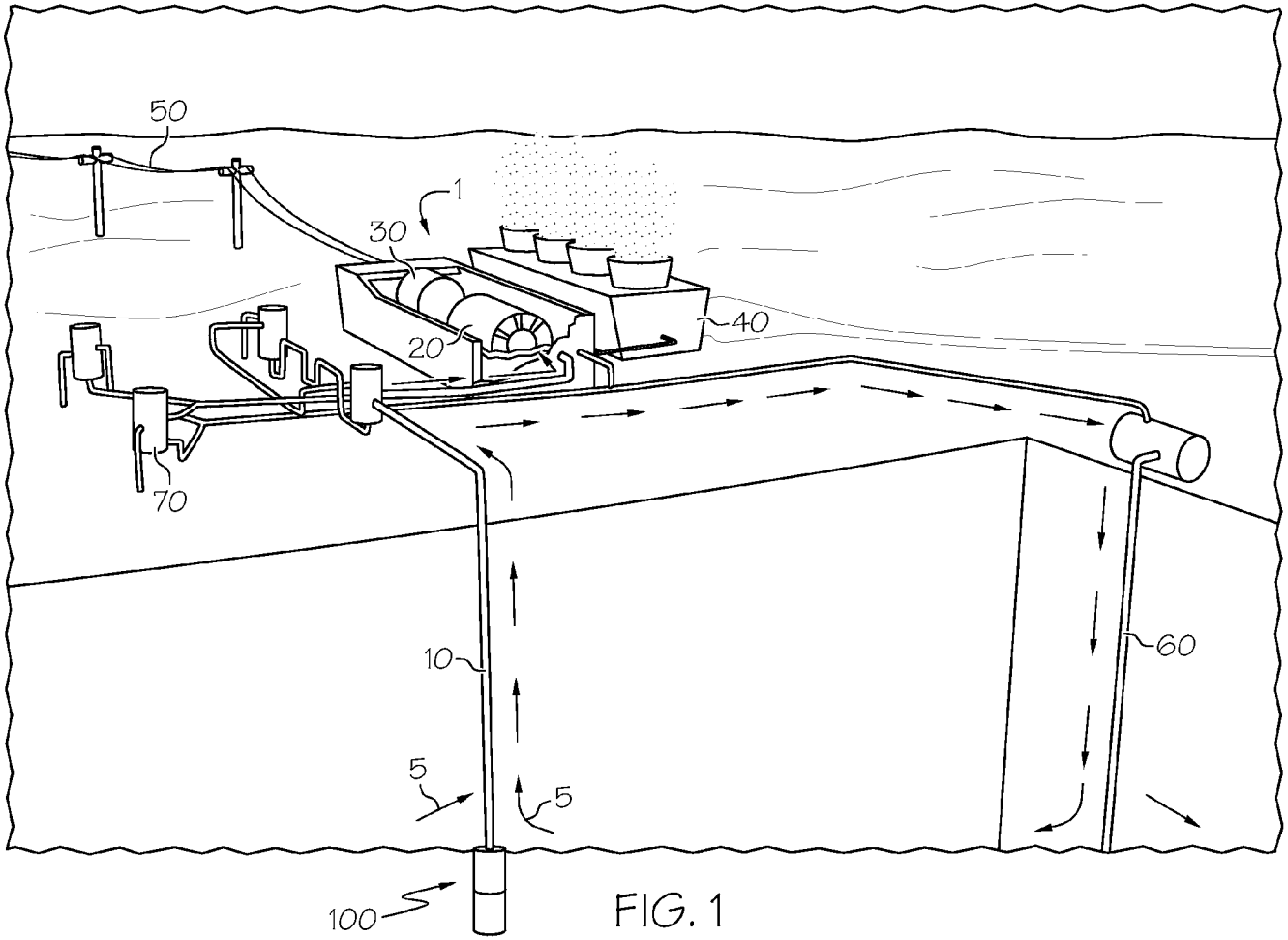
FIG. 1 shows a notional geothermal power plant that can utilize a DWS pumping system.

The embodiments set forth in the drawings are illustrative in nature and are not intended to be limiting of the embodiments defined by the claims. Moreover, individual aspects of the drawings and the embodiments will be more fully apparent and understood in view of the detailed description that follows.

DETAILED DESCRIPTION OF THE PREFERRED EMBODIMENTS

Figure 2:
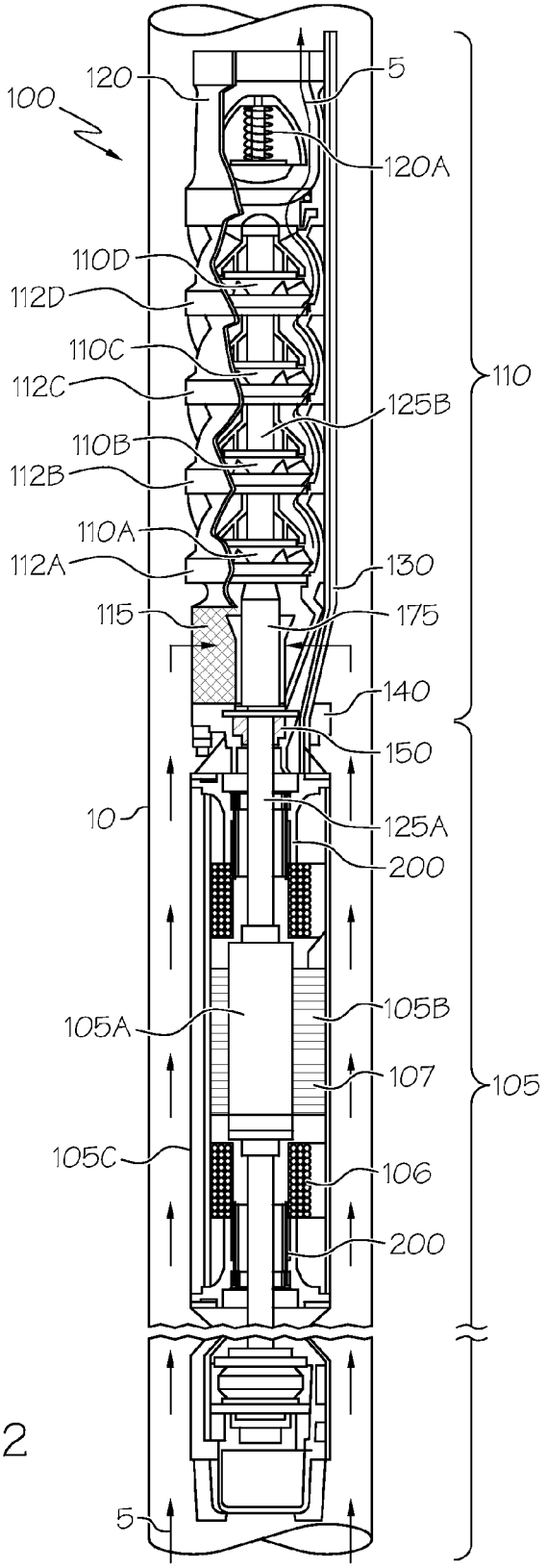
FIG. 2 shows a DWS pumping system of the power plant of FIG. 1, including bearing assemblies according to an aspect of the present invention.

Referring first to FIGS. 1 and 2, a geothermal power plant 1 and a DWS pump 100 employing a radial bearing assembly 200 according to an aspect of the present invention is shown. Naturally-occurring high temperature geothermal fluid in the form of water (for example, between approximately 120° C. and 160° C., depending on the source) 5 from an underground geothermal source (not shown) is conveyed to plant 1 through geothermal production well piping 10 that fluidly connects the DWS pump 100 to a heat exchanger (not shown) that converts the high temperature well water into steam. A steam turbine 20 that turns in response to the high temperature, high pressure steam from the heat exchanger. Plant 1 may also include one or more storage tanks 70 at the surface with which to temporarily store surplus water from the underground geothermal source. The turbine 20 is connected via shaft (not shown) to an electric generator 30 for the production of electric current. The cooled down water is routed from the heat exchanger discharge to be sent to the geothermal source through geothermal injection well piping 60. The electricity produced at the generator 30 is then sent over transmission lines 50 to the electric grid (not shown).

Referring with particularity to FIG. 2, the DWS pump 100 is placed within well piping 10 and includes a motor section 105, a pump section 110, a fluid inlet section 115 to accept a flow of incoming fluid 5, and a fluid outlet section 120 that can be used to discharge the fluid 5 to a riser, pipestack or related fluid-conveying tubing. As shown, both the motor section 105 and the pump section 110 may be made of modular subsections. Thus, within pump section 110, there are numerous serially-arranged subsections in the form of pump bowls 112A, 112B, 112C and 112D that each house respective centrifugal impellers 110A, 110B, 110C and 110D. Likewise, although there is only one motor subsection shown, it will be appreciated that multiple such subsections may be included, such as to satisfy larger power demands or the like. The fluid inlet section 115 is situated axially between the motor and pump sections 105, 110, and may include a mesh or related screen to keep large-scale particulate out in order to avoid or minimize particulate contact with the rotating components in the pump section 110. A seal 150 is used to keep the motor section 105 and the pump section 110 fluidly separate, as well as to reduce any pressure differentials that may exist between the motor section lubricant and the pump section lubricant. As stated above, the temperature of the fluid 5 is typically between approximately 120° C. and 160° C.; however, even at that temperature, the water will remain in a liquid state due to the high surrounding pressure inherent in most geothermal sources. Moreover, because the operating temperature of the motor section is higher than that of the extracted fluid 5, any heat exchange between the flowing fluid 5 and the outer surfaces of motor section 105 tends to cool the motor section 105 and the various components within it.

Motor section 105 has a casing, outer wall or related enclosure 105C that is preferably filled with oil or a related lubricant (not shown) that additionally possesses a high dielectric strength and thermally insulative properties to protect the various induction motor windings, as well as provide lubrication to the motor bearings. By such construction, the motor internal components are fluidly isolated from the pumped geothermal well water. Heat generated within the motor section 105 is efficiently carried by the internal oil to the enclosure 105C, where it can exchange heat with the water being pumped that passes over the outside of the enclosure 105C. Because the lubricant inside the enclosure 105C is of a high temperature (for example, up to about 200° C.), the motor bearings (not shown) must be designed for such temperatures, with an operating lifetime of about 40,000 hours over about 250 motor start-ups. The predicted revolutions range of DWS pump 100 is between about 1,800 revolutions per minute and about 3,600 revolutions per minute. As stated above, the lubricant used inside the enclosure 105C of the motor section 105 is fluidly isolated from the pump section 110. Thus, absent a complex piping scheme (not employed herein), the oil contained within the enclosure 105C of motor section 105 cannot be routed to other locations within the pump 100. As such, another fluid 5, such as the well water being pumped, must be used to provide lubrication of the bearing assembly 200 (discussed below). This can lead to configurational simplicity in that the fluid being pumped from the deep well can serendipitously be used to perform the hydrodynamic function required by the bearing assembly 200. Nevertheless, such a configuration means there is a reduced opportunity to provide cooling to the bearing assembly 200 in the motor section 105, as well as to provide ample bearing lubrication during DWS pump 100 startup conditions.

A shaft, which includes a motor shaft section 125A and a pump shaft section 125B, extends over the length of DWS pump 100. The motor shaft section 125A extends out of the upper end of the motor section enclosure 105C, and is fluidly isolated between the motor and pump sections 105 and 110 by the aforementioned seals 150. Motor shaft section 125A is connected by a coupling 175 to pump shaft section 125B which is surrounded by and frictionally engages numerous bearings, including the radial bearing assembly 200 that is used to transmit normal loads (i.e., those perpendicular to the axial dimension of shafts 125A and 125B) from shaft eccentricities or the like to the remainder of the DWS pump 100, thereby reducing the impact of shaft wobbling on other components. The bearing assembly 200, as well as various other bearings (such as the ones housed in the pump section 110), are spaced along the length of shaft 125 at rotor dynamically advantageous locations. It will be understood by those skilled in the art that the number of radial bearings may vary according to the number of adjacently-joined shaft members, or other criteria. The present bearing assembly 200 is considered to be radial in nature because of its ability to carry radial (rather than thrust or related axial) loads, which are commonly transmitted through roller, tapered or related thrust-conveying mechanisms that are not discussed in further detail.

Motor section 105 includes an induction motor (for example, a squirrel-cage motor) that includes a rotor 105A and a stator 105B that operates by induction motor and related electromagnetic principles well-known to those skilled in the art. As will be additionally understood by those skilled in the induction motor art, stator 105B may further include coil winding 106 and a laminate plate assembly 107. As will be further understood by those skilled in the induction motor art, motor section 105 may be made from numerous modular subsections (with corresponding rotors 105A and stators 105B) axially coupled to one another. Electric current is provided to stator 105B by a power cable 130 that typically extends along the outer surface defined by enclosure 105C. Power cable 130 is in turn electrically coupled to a source. Operation of motor section 105 causes the motor shaft section 125A and pump shaft section 125B of the shaft that is coupled to the rotor 105A to turn, which by virtue of the pump shaft section 125B connection to the one or more serially-arranged centrifugal impellers 110A, 110B, 110C and 110D in the pump section 110 turns them so that a fluid (such as the high temperature water resident in the geothermal source and shown presently as the serpentine line 5 in the upper right of the flow path of the pump section 110) can be pressurized and conveyed to the power plant 1 on the earth's surface. A check valve 120A can be situated in the fluid outlet section 120 that is fluidly connected to and downstream of the pump section 110. Flanged regions 140 are used to couple the various sections 105 and 110 together. Such flanged regions 140 may be secured together using bolted arrangement or some related method known to those skilled in the art.

Figure 3:
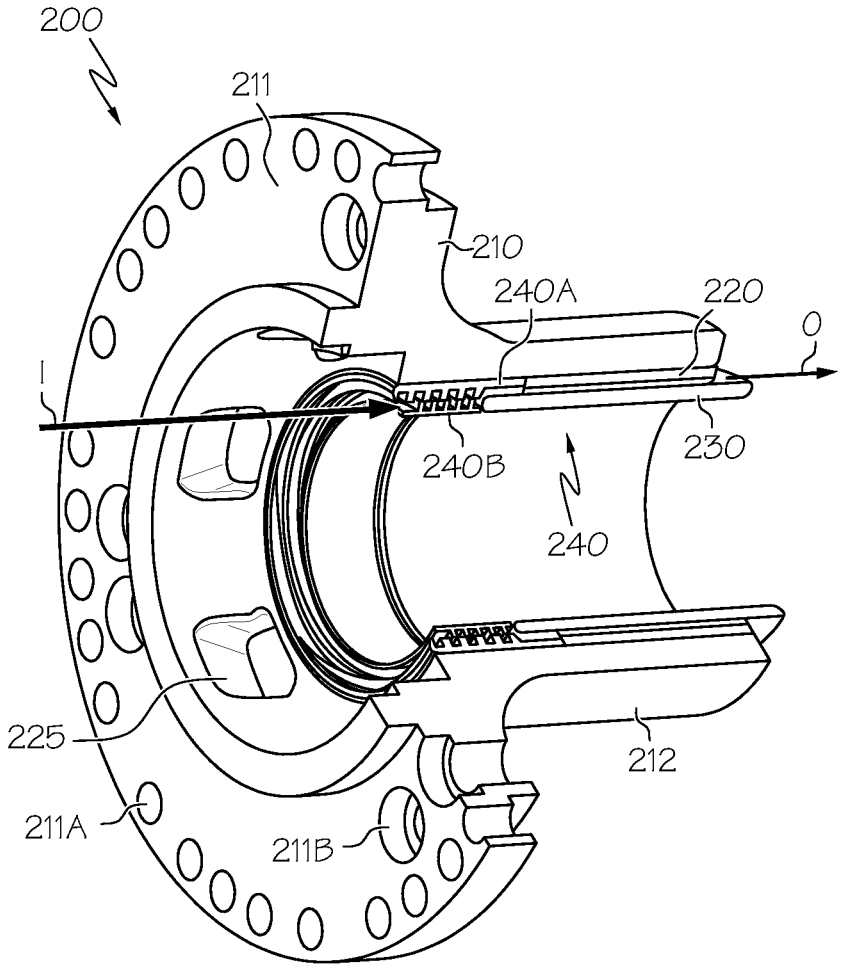
FIG. 3 shows details of one of the bearing assemblies employed in the DWS pumping system of FIG. 2.
Figure 4:
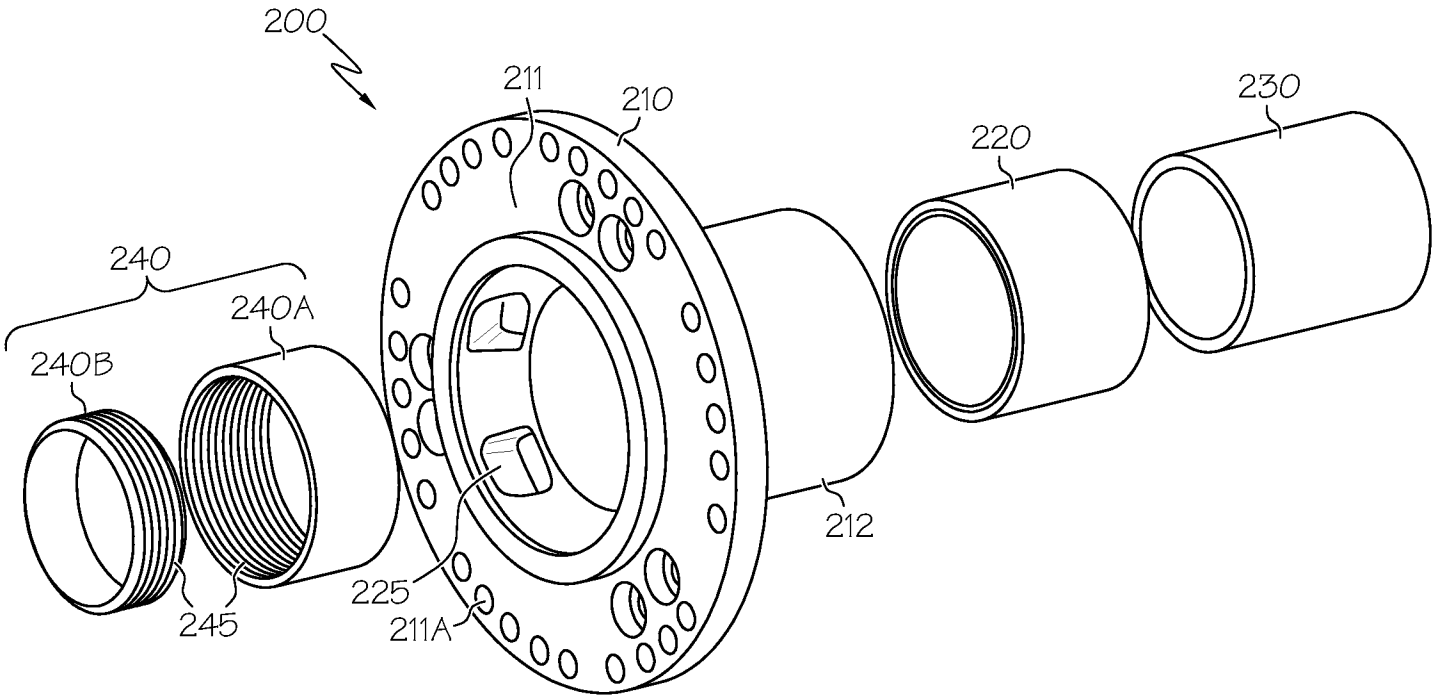
FIG. 4 shows an exploded view of some of the components of the bearing assembly of FIG. 3.

Referring next to FIGS. 3 and 4, the radial bearing assembly 200 is shown (in FIG. 3) with its major components in exploded form (in FIG. 4). As discussed above, each of the motor section 105 and the pump section 110 of DWS pump 100 may be made up of numerous subsections, with such number dictated by the pumping requirements of the application. More particularly, within motor section 105 the number of stators 105B that can be made to cooperate with rotor or rotors 105A is commensurate with the power requirements of the DWS pump 100. In such a multiple stator configuration, each stator 105B within motor section 105 would have two radial bearing assemblies 200, arranged as substantial minor images of one another on opposing axial ends of the stator 105B.

Assembly 200 includes a housing 210 that can be matingly connected to an appropriate location on the motor section 105 of DWS pump 100. In one form, a flange 211 forms part of the housing 210 and includes numerous apertures 211A formed therein; some of the apertures 211A can be used in conjunction with bolts or related fasteners to establish a flanged and bolted relationship, while others can be used as backflow holes for any cooling fluid (not shown). Other larger versions 211B of the apertures are situated radially inward and can be used as a passageway for electrical wire and related power cables. In one form, the flanged relationship between adjacent housings 210 may be effected by connection to flanged region 140 that is depicted in FIG. 2. The housing 210 also includes an axially-extending outer wall 212 that defines a generally smooth sleeve-like inner surface that is sized to form a tight fit (for example, a shrink fit or press-fit between the radial bearing housing 210 with a corresponding outer surface of a bushing 220 that together with a bearing sleeve 230 forms a part of radial bearing assembly 200 that transmits loads between the shaft 125 and the remainder of the DWS pump 100. The bearing sleeve 230 is sized to fit within the bushing 220 such that the outer surface of bearing sleeve 230 is in close cooperation with the inner surface of bushing 220. In this way, when assembled, the housing outer wall 212, the bushing 200 and the bearing sleeve 230 exhibit a nested or concentric relationship with one another.

Lubricant is forced between the bearing sleeve 230 and bushing 220 by a dual screw pump 240 that is made up of a housing screw 240A and a shaft screw 240B. As stated above, the lubricant being pumped is preferably oil contained within the motor section so that it is fluidly decoupled from the geothermal water being moved by DWS pump 100. The outer surface of shaft screw 240B and the inner surface of the housing screw 240A have continuous threads 245 formed on them. The threads 245 from each of the screws 240A, 240B mesh together upon assembly to define a positive-displacement screw conveyor with one or more lubricant pumping passages that pressurize an incoming fluid I (shown in FIG. 3) to force it along the axial dimension of the interstitial space between bushing 220 and the bearing sleeve 230, after which it is output, indicated at O in FIG. 3. Apertures 225 formed between flange 211 and the housing outer wall 212 provide a lubricant flow path that is used to feed lubricant from a lubricant supply (not shown) to the screw pump 240.

The dual conveying screws 240A and 240B of the radial bearing assembly 200 take the lubricating fluid used in motor section 105 and compress it to ensure reliable and sufficient lubrication between the bearing sleeve 230 and the bushing 220. Specifically, screw 240B rotates while conveying screw 240A remains stationary. In this way, the radial bearing assembly 200 operates with a significant reduction in friction not only during operation of the DWS pump 100 in high temperature environments, but also during the start-up and shut-down phases, thereby taking full advantage of their hydrodynamic properties. Further, the positioning of the dual conveying screws 240A and 240B in front of the bushing 220 and bearing sleeve 230 may increase the radial load capacity of the radial bearings. Specifically, the radial bearing assembly 200 creates head due to the load and speed in the lubrication gap formed between the bearing sleeve 230 and the bushing 220. Because of the additional heat, the viscosity of the lubricating fluid drops, which causes a reduction in the lubrication film thickness and a concomitant decrease the load capacity. This can be compensated for by increasing the flow through the radial bearing assembly 200, which acts to help the assembly stay cooler, which in turn results in a higher viscosity in the lubrication film. Also, it is contemplated that for operating the motor with a variable frequency drive, the bearings may be coated with a thin layer of an electrical insulation material having excellent mechanical properties on the fitting diameter.

Figure 5A:
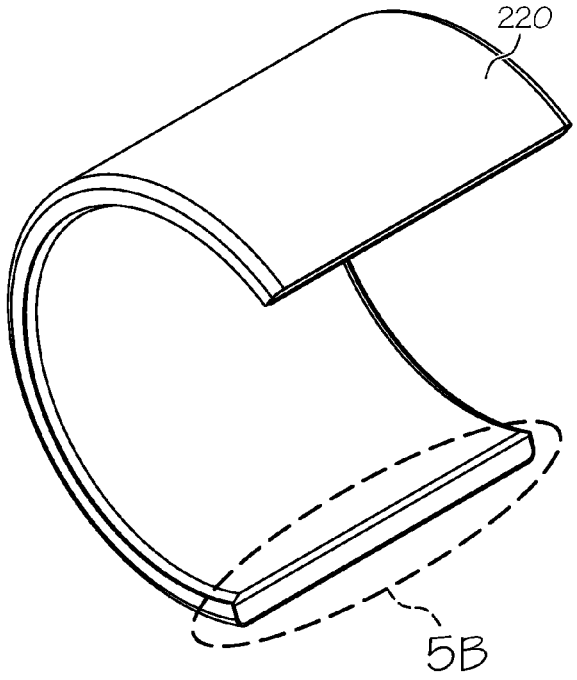
FIG. 5A shows a cutaway view of the bushing employed in the bearing assembly of FIG. 3.
Figure 5B:
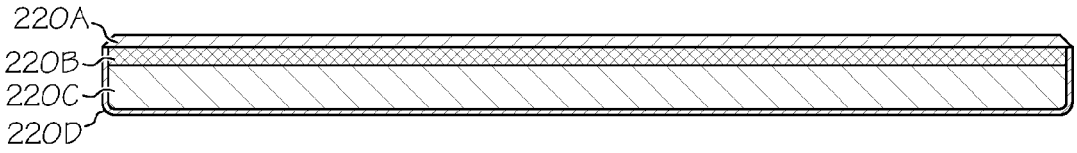
FIG. 5B shows the details of the layers making up the bushing of FIG. 5A.

Referring next to FIGS. 5A and 5B, a cutaway view of the bushing 220 (FIG. 5A) and its multilayered construction (FIG. 5B) are shown. As can be seen with particularity in FIG. 5B, the innermost layer 220A (i.e., the one which will engage the outer surface of the bearing sleeve 230) is made from a galvanized tin, preferably between about a couple of micrometers thick. Directly underneath that is a bronze layer 220B that is about 2 millimeters in thickness. Beneath that, a thicker steel housing (preferably 5 millimeters thick) 220C can be used, itself surrounded by an outermost layer 220D of an electrically insulative material, such as PEEK or a related structurally suitable polymeric. This is especially beneficial in situations where the motor section 105 is run in a variable frequency drive (VFD) mode of operation, such as between the above-stated 1800 and 3600 RPM. The thickness dimensions of the various layers of FIG. 5B are not necessarily shown to scale. For example, the thickness of the innermost layer 220A may be (as indicated above) about three orders of magnitude thinner than the bronze layer 220B.

It will be appreciated that while the present description focuses primarily on distributing lubricant within a submersible motor such as for a DWS pumping system, the technique can be utilized in a variety of other components and applications above or below the surface of the earth. It is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment. Likewise, for the purposes of describing and defining embodiments herein it is noted that the terms "substantially," "significantly," "about" and "approximately" that may be utilized herein represent the inherent degree of uncertainty that may be attributed to any quantitative comparison, value, measurement or other representation. Such terms are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed is:

1. A method of pumping a geothermal fluid, said method comprising:

placing a deep well submersible pump in fluid communication with a source of geothermal fluid, said pump comprising:

a motor comprising a rotor and a stator one of which comprises an induction coil cooperative with a shaft such that upon passage of electric current through said induction coil, rotating movement is imparted to said shaft;

at least one impeller rotatably mounted to said shaft;

a fluid inlet and a fluid outlet in fluid communication with one another through said at least one impeller; and at least one bearing assembly cooperative with said shaft, said at least one bearing assembly comprising a bearing sleeve and a multilayer bushing cooperative with one another to define a lubricant pumping flow path that is configured to deliver a lubricant to said stator and said rotor such that a substantially continuous lubricant environment is established therebetween; and operating said pump such that said lubricant pumping flow path pressurizes said lubricant to flow between said bushing and said bearing sleeve to achieve substantially continuous lubrication thereof during pumping of said geothermal fluid, wherein said method further comprises the step of directly delivering said pressurized lubricant generated by a screw pump to said at least one bearing assembly.

2. The method of claim 1, wherein said bushing and said bearing sleeve are configured to operate in a substantially continuous lubricant environment of at least 120 degrees Celsius.

3. The method of claim 1, wherein said bushing comprises at least one metal and a second material used to cover said at least one metal.

4. The method of claim 3, wherein said at least one metal layer comprises a plurality of metal layers at least one of which is made from a metal dissimilar to that of the remaining layers.

5. The method of claim 4, wherein said plurality of metal layers comprises a galvanized tin layer, a bronze layer and a steel layer.

6. The method of claim 4, wherein said second material comprises an electrically nonconductive material that forms an outermost layer of said bushing.

7. The method of claim 3, wherein said second material comprises an electrically nonconductive material that forms an outermost layer of said bushing.

8. The motor of claim 7, wherein said electrically nonconductive material comprises polyaryletheretherketone.

9. The method of claim 1, wherein said lubricant pumping flow path is cooperative with a first pumping mechanism mounted to a non-rotational portion of said bearing assembly and a second pumping mechanism mounted to said shaft such that upon rotation of said shaft, said first and second pumping mechanisms cooperate to achieve said pressurizing of said lubricant in said lubricant pumping flow path.

10. The method of claim 9, further comprising a threaded relationship between said first and second pumping mechanisms to achieve said pressurizing cooperation therebetween.

11. A method of operating a geothermal fluid pump, said method comprising:

configuring said pump to comprise:

at least one impeller rotatably mounted to a shaft;

a fluid inlet and a fluid outlet in fluid communication with one another through said at least one impeller;

an induction motor cooperative with a shaft to impart rotating movement thereto; and at least one bearing assembly comprising a bearing sleeve and a multilayer bushing cooperative with one another to define a lubricant pumping flow path that is configured to deliver a lubricant to a stator and a rotor of said motor such that a substantially continuous lubricant environment is established therebetween; and providing electric current to said motor such that upon rotational movement thereof, said lubricant pumping flow path pressurizes lubricant disposed therein to force it to flow between said multilayer bushing and said bearing sleeve to achieve substantially continuous lubrication thereof, wherein said method further comprises the step of directly delivering said pressurized lubricant generated by a screw pump to said at least one bearing assembly.

12. The method of claim 11, wherein at least one of said rotor and said stator comprises an induction coil cooperative with said shaft.

13. The method of claim 12, further comprising disposing piping about said shaft, said rotor, said stator and said bearing assembly and defining a geothermal fluid passage therein that is fluidly decoupled from said bearing assembly such that said geothermal fluid conveyed therethrough removes heat from said bearing assembly while being maintained in fluid isolation from said lubricant.

14. The method of claim 11, wherein said lubricant pumping flow path is cooperative with a first pumping mechanism mounted to a non-rotational portion of said bearing assembly and a second pumping mechanism mounted to said shaft such that upon rotation of said shaft, said first and second pumping mechanisms cooperate to achieve said pressurizing of said lubricant in said lubricant pumping flow path.

15. The method if claim 14, wherein said first and second pumping mechanisms comprise a housing-mounted screw and a shaft-mounted screw threadably cooperative with one another to define at least a portion of said lubricant pumping flow path.

16. The method of claim 11, wherein said bushing comprises at least one metal and a second material used to cover said at least one metal.

17. The method of claim 16, wherein said at least one metal layer comprises a plurality of metal layers at least one of which is made from a metal dissimilar to that of the remaining layers.

18. The method of claim 17, wherein said second material comprises an electrically nonconductive material that forms an outermost layer of said bushing.

19. The method of claim 16, wherein said second material comprises an electrically nonconductive material that forms an outermost layer of said bushing.

* * * * *

UNITED STATES PATENT AND TRADEMARK OFFICE

CERTIFICATE OF CORRECTION

PATENT NO. : 9,011,115 B2
APPLICATION NO. : 14/066840
DATED : April 21, 2015
INVENTOR(S) : Behrend Goswin-Schlenhoff et al.

It is certified that error appears in the above-identified patent and that said Letters Patent is hereby corrected as shown below:

In the Specification:

Col. 7, Line 22,
"minor images of one another on opposing axial ends of the" should read
--mirror images of one another on opposing axial ends of the--; and In the Claims:

Col. 10, Claim 15, Line 60,
"15. The method if claim 14, wherein said first and second" should read
--15. The method of claim 14, wherein said first and second--.

Signed and Sealed this
Twenty-third Day of August, 2016

Michelle K. Lee

Michelle K. Lee
*Director of the United States Patent and Trademark Office*